US007228707B2

(12) United States Patent
Lifson et al.

(10) Patent No.: US 7,228,707 B2
(45) Date of Patent: Jun. 12, 2007

(54) HYBRID TANDEM COMPRESSOR SYSTEM WITH MULTIPLE EVAPORATORS AND ECONOMIZER CIRCUIT

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 276 days.

(21) Appl. No.: 10/975,862

(22) Filed: Oct. 28, 2004

(65) Prior Publication Data

US 2006/0090503 A1 May 4, 2006

(51) Int. Cl.
*F25B 1/10* (2006.01)

(52) U.S. Cl. ..... 62/510; 62/513

(58) Field of Classification Search ..... 62/510, 62/513, 175, 196.4, 225, 509; 417/244, 248
See application file for complete search history.

(56) References Cited

U.S. PATENT DOCUMENTS 4,976,116 A * 12/1990 Hayama et al. ..... 62/441
5,095,712 A * 3/1992 Narreau ..... 62/113
5,276,630 A * 1/1994 Baldwin et al. ..... 700/276
6,293,119 B1 * 9/2001 Wenzel ..... 62/238.6

OTHER PUBLICATIONS

International Search Report Dated Dec. 1, 2006 *U.S. References 4,976,116 & 6,293,119 already cited by examiner.

* cited by examiner

*Primary Examiner*—Melvin Jones
(74) *Attorney, Agent, or Firm*—Carlson, Gaskey & Olds

(57) ABSTRACT

A tandem compressor refrigerant cycle with an economizer circuit is introduced to provide additional capacity and improve system efficiency. In this system, tandem compressors deliver compressed refrigerant to a common discharge manifold, and then to a common condenser. From the common condenser, the refrigerant passes to a plurality of evaporators, with each of the evaporators being associated with a separate environment to be conditioned. Each of the evaporators is associated with one of the plurality of compressors. By utilizing the common condenser, and yet a plurality of evaporators, the ability to independently condition a number of environments is achieved without the requirement of the same plurality of separate complete refrigerant circuits for each of the environments. In some embodiments, several of the plurality of compressors can be provided by compressor banks having its own plurality of compressors. Some of the compressors in the compressor bank can have intermediate injection ports to accept refrigerant vapor from the economizer circuit. In particular, the economizer circuit provides additional capacity to the evaporators with relatively high load requirements.

19 Claims, 3 Drawing Sheets

HYBRID TANDEM COMPRESSOR SYSTEM WITH MULTIPLE EVAPORATORS AND ECONOMIZER CIRCUIT

BACKGROUND OF THE INVENTION

This application relates to a refrigerant cycle utilizing tandem compressors sharing a common condenser, but having separate evaporators, and wherein an economizer circuit is employed.

Refrigerant cycles are utilized in applications to change the temperature and humidity or otherwise condition the environment. In a standard refrigerant system, a compressor delivers a compressed refrigerant to an outdoor heat exchanger, known as a condenser. From the condenser, the refrigerant passes through an expansion device, and then to an indoor heat exchanger, known as an evaporator. At the evaporator, moisture may be removed from the air, and the temperature of air blown over the evaporator coil is lowered. From the evaporator, the refrigerant returns to the compressor. Of course, basic refrigerant cycles are utilized in combination with many configuration variations and optional features. However, the above provides a brief understanding of the fundamental concept.

In more advanced refrigerant systems, a capacity of the air conditioning system can be controlled by the implementation of so-called tandem compressors. The tandem compressors are normally connected together via common suction and common discharge manifolds. From a single common evaporator, the refrigerant is returned through a suction manifold, and then distributed to each of the tandem compressors. From the individual compressors the refrigerant is delivered into a common discharge manifold and then into a common single condenser. The tandem compressors are also separately controlled and can be started and shut off independently of each other such that one or both compressors may be operated at a time. By controlling which compressor is running, control over the capacity of the combined system is achieved. Often, the two compressors are selected to have different sizes, such that even better of capacity control is provided. Also, tandem compressors may have shutoff valves to isolate some of the compressors from the active refrigerant circuit, when they are shutdown. Moreover, if these compressors operate at different suction pressures, then pressure equalization and oil equalization lines are frequently employed.

One advantage of the tandem compressor is that better capacity control is provided, without the requirement of having each of the compressors operating on a dedicated circuit. This reduces the system cost.

However, certain applications require cooling at various temperature levels. For example, in supermarkets, low temperature (refrigeration) cooling can be provided to a refrigeration case by one of the evaporators connected to one compressor and intermediate temperature (perishable) cooling can be supplied by another evaporator connected to another compressor. In another example, a computer room and a conventional room would also require cooling loads provided at different temperature levels, which can be supplied by the proposed multi-temp system as desired. However the cooling at different levels will not work with application of standard tandem compressor configuration, as it would require the application of a dedicated circuit for each cooling level. Each circuit in turn must be equipped with a dedicated compressor, dedicated evaporator, dedicated condenser, and dedicated evaporator and condenser fans. This arrangement having a dedicated circuitry for each temperature level would be very expensive.

In addition, a technique known as an economizer circuit has been utilized in the refrigerant systems. The economizer circuit increases the capacity and efficiency of a refrigerant cycle. To this point, a system having a common condenser communicating with several evaporators has not been utilized in combination with an economizer circuit. Notably, applicants have a co-pending application, filed on even date herewith, entitled "Refrigerant Cycle With Tandem Compressors for Multi-Level Cooling, and assigned Ser. No. 10/975,887.

SUMMARY OF THE INVENTION

For the simplest system that has only two compressors, in this invention, as opposed to the conventional tandem system, there is no suction manifold connecting the tandem compressors together. Each of the tandem compressors is connected to its own evaporator, while both compressors are still connected to a common discharge manifold and a single condenser. Consequently, for such tandem compressor system configurations, additional temperature levels of cooling, associated with each evaporator, become available. An amount of refrigerant flowing through each evaporator can be regulated by flow control devices placed at the compressor suction ports, as well as by controlling related expansion devices or utilizing other control means, such as evaporator airflow. In addition, in this application, an economizer circuit is incorporated into the refrigerant cycle. The economizer circuit maybe utilized with one or several of the evaporators. In particular, although the economizer circuit may increase the capacity of each evaporator, it would preferably be utilized with the evaporator associated with the environment that must be conditioned at the lowest temperature, since the economizer circuit provides the greatest advantages at higher pressure ratios.

In a disclosed embodiment of this invention, precise control of various sub-sections of an environment can be achieved by utilizing distinct evaporators for each of the separate areas. Each of the evaporators communicates with a separate compressor, while the compressors send compressed refrigerant through a common discharge manifold to a common condenser. Thus, there is no need in providing all of the components of two individual refrigerant circuits (such as an additional condenser and additional condenser fans). In this manner, a separate cooling control of each of the cooling temperature zones is achieved.

It should be understood that if more than two tandem compressors are connected together, then the system can operate at each additional temperature levels associated with the added compressor. For example, with three compressors, operation at three temperature levels can be achieved by connecting each of the three compressors to a dedicated evaporator. In another arrangement two out of the three compressors can operate with common suction and discharge manifold and be connected to the same evaporator, while the third compressor can be connected to a separate evaporator. Of course, the tandem application can be extended in an analogous manner to more than three compressors.

In embodiments, only one or several of the evaporators may be associated with the economizer circuit. In the economizer circuit, a portion of the refrigerant is then returned to an intermediate compression position in at least one of the compressors, as known.

These and other features of the present invention can be best understood from the following specification and drawings, the following of which is a brief description.

DETAILED DESCRIPTION OF THE PREFERRED EMBODIMENT

Figure 1:
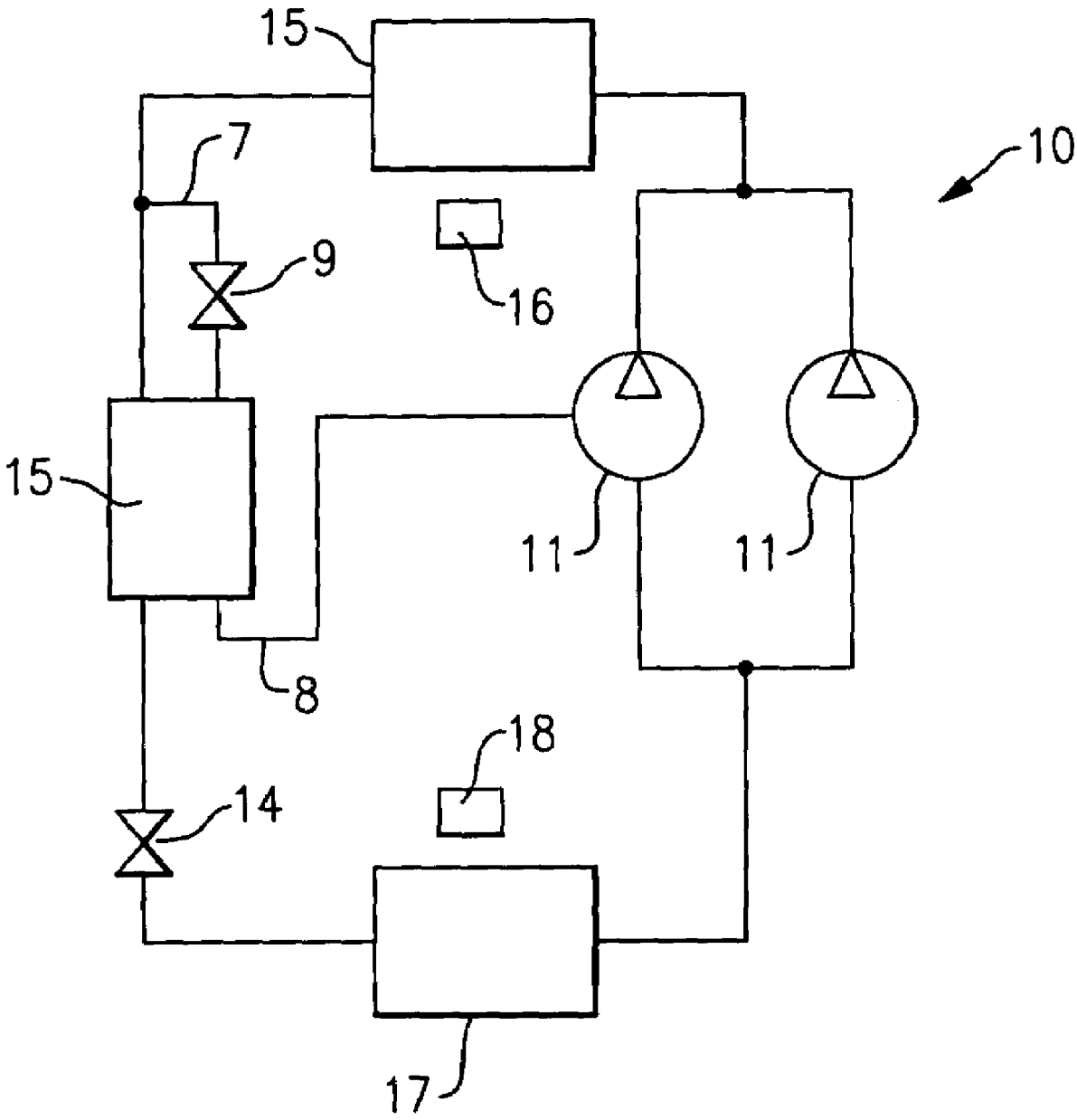
FIG. 1 shows an earlier system.

Referring to FIG. 1, earlier tandem compressor system 10 is shown to include two separate compressors 11, an evaporator 17, condenser 15, expansion device 14, condenser fan 16, evaporator fan 18 and associated piping. An economizer circuit includes an economizer heat exchanger 15 receiving a main refrigerant flow and a tapped refrigerant flow tapped from the main circuit into a refrigerant line 7. As known, the tapped refrigerant flow passes through an expansion device 9. Downstream of the economizer heat exchanger 15, the tapped flow is returned through a refrigerant line 8 to an intermediate compression point in at least one of the compressors 11. Such a system was disclosed in a prior U.S. patent application Ser. No. 10/769,161, filed 30 Jan. 2004 and entitled "Refrigerant Cycle With Tandem Economized and Conventional Compressors" and assigned to the assignee of the present invention. Obviously, more than two compressors can be utilized in the tandem configuration with more then one conventional compressor and more than one economized compressor in the assembly.

Figure 2:
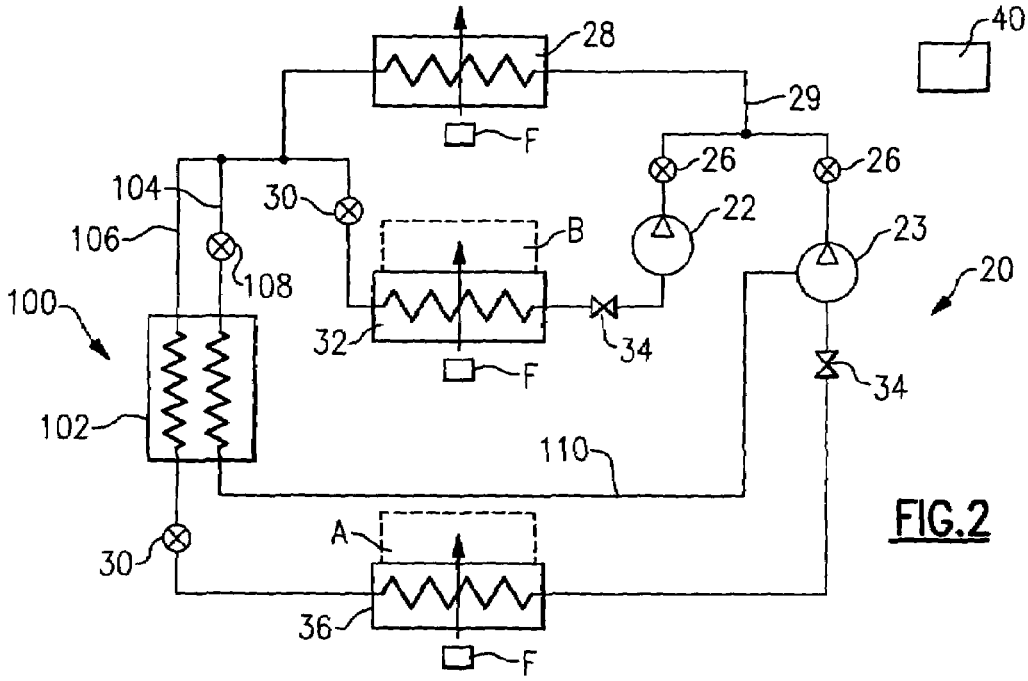
FIG. 2 is a first schematic.

A refrigerant system 20 is illustrated in FIG. 2 having a pair of compressors 22 and 23 that are operating generally as tandem compressors. Valves 26 are positioned downstream on a discharge line associated with each of the compressors 22 and 23. These valves can be controlled to prevent backflow of refrigerant to either of the compressors 22 or 23 should only one of the compressors be operational. That is, if, for instance, the compressor 22 is operational with the compressor 23 stopped, then the valve 26 associated with the compressor 23 will be closed to prevent flow of refrigerant from the compressor 22 back to the compressor 23. The two compressors communicate with a discharge manifold 29 leading to a single condenser 28. From the condenser 28, the refrigerant continues downstream and is split into two flows each heading through an expansion device 30. From the expansion device 30, one of the flows passes through a first evaporator 32 for conditioning a sub-environment B. The refrigerant passing through the evaporator 32 passes through a suction modulation valve 34, and is returned to the compressor 22. The second flow path passes through an evaporator 36 that is conditioning a sub-environment A. The refrigerant also passes through an optional suction modulation valve 34 and is returned to the compressor 23. Fan F1 drives air over the evaporator 32 and fan F2 drives air over the evaporator 36 and into their respective sub-environments.

A control 40 for the refrigerant cycle 20 is operably connected to control the compressors 22 and 23, expansion valves 30, discharge valves 26 and suction modulation valves 34. By properly controlling each of these components in combination, the conditions in each evaporator 32 and 36 can be controlled as desired for the sub-environments A and B. The exact controls necessary are as known in the art, and will not be explained here. However, the use of the tandem compressors 22 and 23 utilizing a common condenser 28 reduces the number of system components necessary for providing the independent control for the sub-environments A and B, and thus is an improvement over the prior art.

As shown in FIG. 2, an economizer circuit 100 is incorporated into the refrigerant cycle 20. An economizer heat exchanger 102 receives a tapped refrigerant from an economizer tap 104 and a main refrigerant from a refrigerant line 106. Notably, the refrigerant heading to the evaporator 32 does not pass through the economizer heat exchanger 102, while the refrigerant heading to the evaporator 36 does. In this embodiment, the evaporator 36 is preferably to be cooled and its sub-environment A is preferably to be conditioned to the coolest temperature. The use of the economizer circuit will provide additional cooling capacity in the evaporator 36, as known. The refrigerant passing through the tap 104 passes through an auxiliary expansion device 108. This refrigerant is expanded to a lower pressure and temperature and thus is able to subcool the refrigerant in the main refrigerant line 106 in the economizer heat exchanger 102. The tapped refrigerant, having been expanded and passed through the economizer heat exchanger 102, is returned through a return line 110 to an intermediate position in at least one of the compressors, shown here as compressor 23. Notably, while the refrigerant flow of the lines 104 and 106 is shown in the same direction through the economizer heat exchanger 102, for all of the embodiments in this invention, it is preferred these two flows are arranged in a counter-flow relationship, however, they are shown in the same direction for the illustration simplicity. Also, as known in the art, the refrigerant can be tapped into the economizer circuit downstream of the economizer heat exchanger 102, providing identical advantages and performance improvement. Thus, in either case, the use of the economizer circuit 100 provides additional cooling capacity to the refrigerant system 20.

For this embodiment, and for all other disclosed embodiments, there is an option where the control can also selectively open the economizer expansion device to either allow flow through the economizer heat exchanger, or to block flow through the economizer heat exchanger. When the economizer expansion device is shut off, refrigerant would still pass through the economizer heat exchanger through the main flow line, however, the economizer function would not be operational. Rather than having a single economizer expansion device that also operates as a shut-off valve, two distinct fluid control devices could be utilized.

Figure 3:
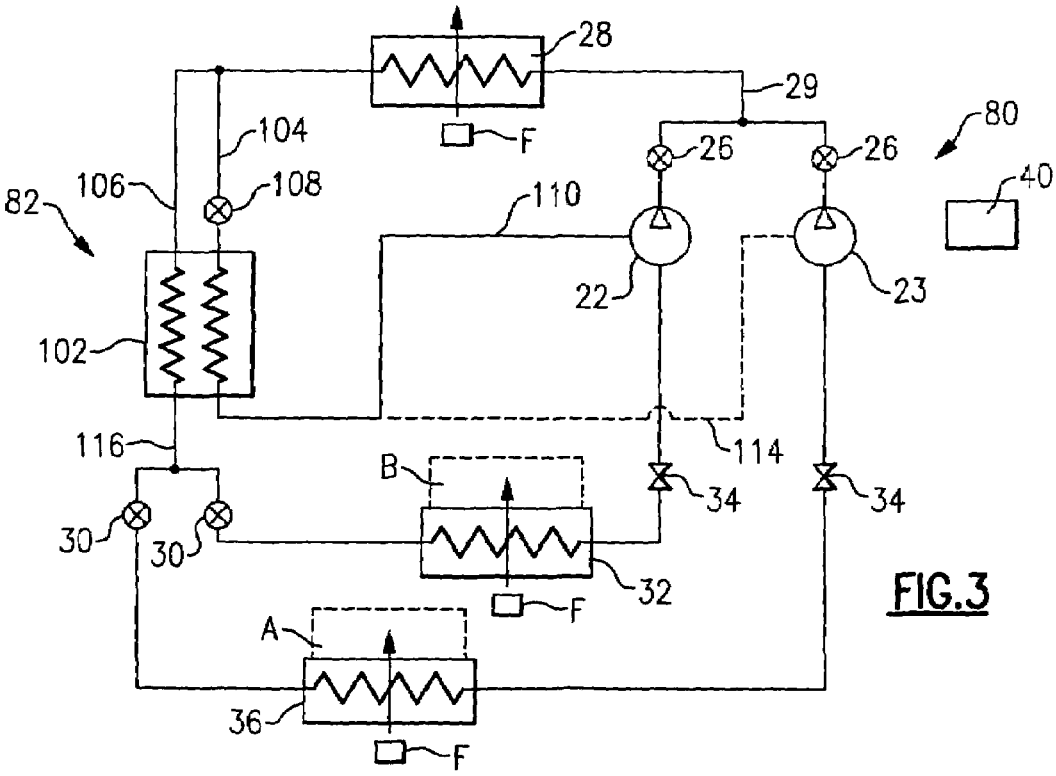
FIG. 3 is a second schematic.

FIG. 3 shows another embodiment 80 that is quite similar to the embodiment 20 of FIG. 2. However, the refrigerant flowing to both of the evaporators 32 and 36 also passes through the economizer heat exchanger 102. As shown, the main flow of refrigerant in the refrigerant line 106, after having been passed through the economizer heat exchanger 102, leads to a downstream manifold 116, which then breaks into two branches leading to both evaporators 32 and 36. The benefits of additional capacity are thus provided to both of the evaporators 32 and 36. As shown, the tapped refrigerant in the economizer branch would still return to the compressor 22 through the refrigerant line 110. An optional line 114 may also return refrigerant to the other compressor 23, if this compressor is equipped with an intermediate injection port. Obviously, in this case, two separate economizer heat exchangers 102 can be utilized for each compressor, if desired.

Figure 4:
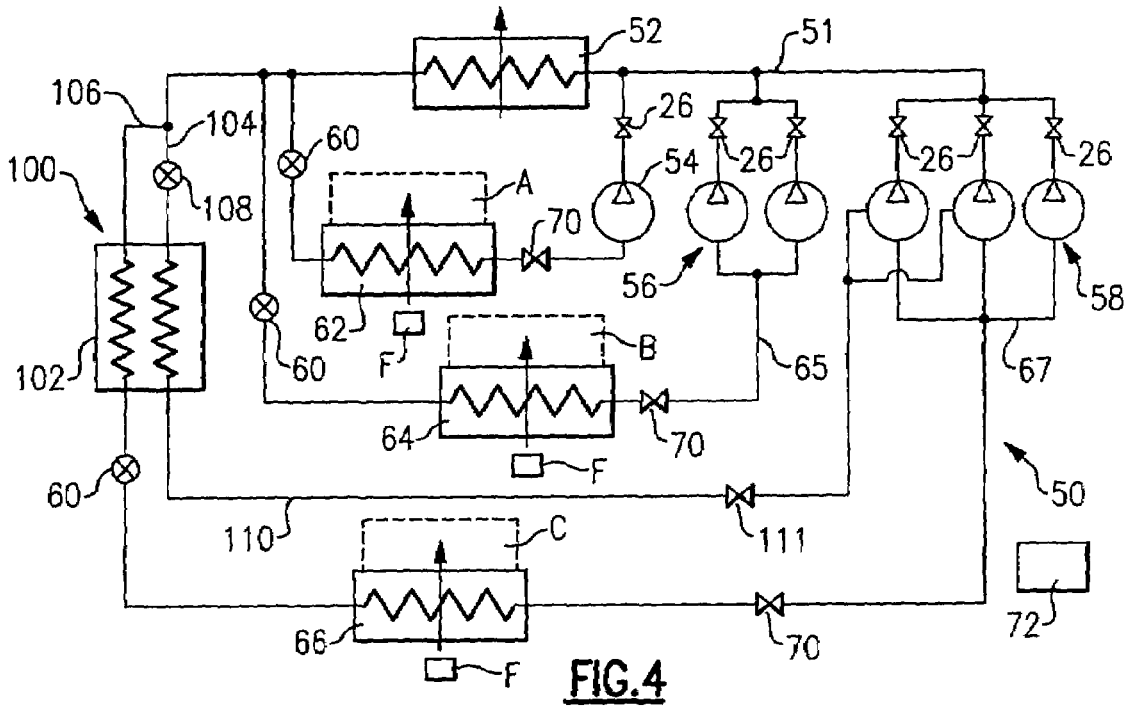
FIG. 4 is a third schematic.

FIG. 4 shows a more complicated refrigerant cycle 50 for conditioning of three sub-environments A, B and C. As shown, a single condenser 52 communicates with a common discharge manifold 51. A first compressor 54 also communicates with the discharge manifold 51. A second compressor bank 56 includes two tandem compressors communicating with a suction manifold 65 and the same discharge manifold 51.

A third compressor bank 58 includes three compressors all operating in tandem and communicating with a suction manifold 67 and, once again, with the discharge manifold 51. The control of the compressor banks 56 and 58 is as known in the art of tandem compressors. As mentioned above, by utilizing the compressor banks 56 and 58, flexibility in control and capacity adjustment is provided for the sub-environments B and C.

From the condenser 52, the refrigerant passes through separate expansion devices 60, and to separate evaporators 62, 64 and 66. As is shown, evaporator 62 conditions the air supplied into a sub-environment A, evaporator 64 conditions the air provided into a sub-environment B, and evaporator 66 conditions the air directed into a sub-environment C. As known in the art, an optional suction modulation valve 70 can be positioned on each of the suction lines returning to the compressors 54, 56 and 58 and a discharge valve 26 can be located on each of the individual discharge lines leading to the common discharge manifold 51. Again, a control 72 is provided that controls each of the components to achieve the desired conditions within each of the sub-environments A, B, and C. The individual control steps taken for each of the sub-environments would be known. It is the provision of the combined system utilizing a common condenser and tandem compressor banks connected to separated evaporators conditioning different sub-environments that is inventive here.

FIG. 4 shows an economizer circuit 100 having a structure and operation similar to that illustrated with regard to FIG. 1. This economizer circuit 100 would operate in a similar manner. As known in the art, an optional shut-off valve 111 is illustrated blocking the return (economizer) flow of refrigerant to the intermediate compression points of only the economized compressors 58 through the line 110. As shown, the return flow through line 110 may lead to several, but not all of the compressors in one of the compressor banks, here compressor bank 58.

Figure 5:
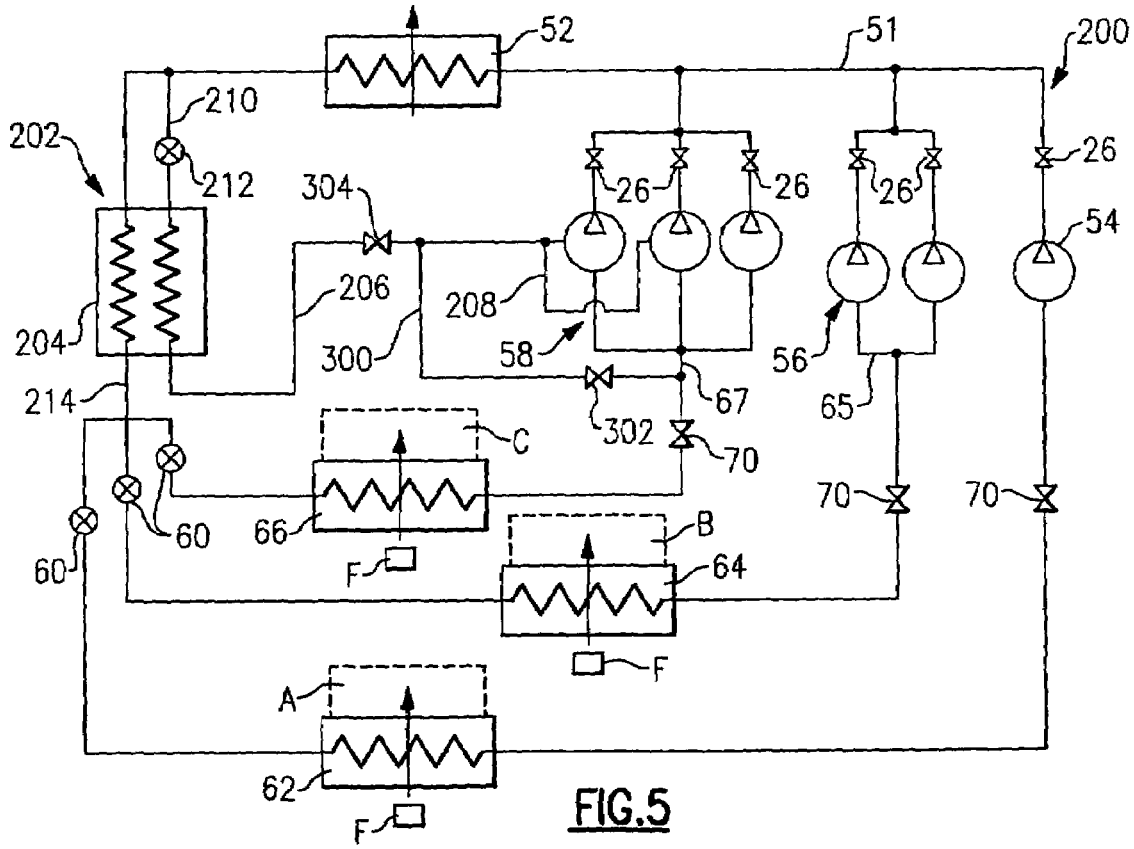
FIG. 5 is a fourth schematic.

FIG. 5 exhibits a refrigerant cycle 200 that is similar to the FIG. 3 refrigerant cycle 50. The refrigerant passing through the economizer heat exchanger 204, however, passes to each of the three evaporators 62, 64, and 66. As shown, a manifold 214 directs the refrigerant downstream of the economizer heat exchanger 204 to each of the evaporators. A return line 206 and branch 208 return the refrigerant to several (two in this case), but not all of the compressors in a compressor bank 58. As before, a tap line 210 passes through an economizer expansion device 212.

As illustrated in this FIG. 5, an additional by-pass line 300 with a shut-off valve 302 can be installed connecting either the refrigerant line 206 or refrigerant line 208 to a common suction manifold 67. (A connection to individual suction lines is also feasible.) This arrangement allows for unloading of at least one of the economized compressors 58 connected to the evaporator 66. An optional shut-off valve 304 can be installed on the economizer line 206 or line 208 to prevent the flow of refrigerant from the economizer heat exchanger toward one or both of the economized compressors. When unloading operation is desired, the valve 302 is opened establishing a direct link for the flow of refrigerant to be by-passed from the intermediate to suction compressor ports. Of course, a similar by-pass arrangement can be applied to all of the embodiments of this application. What is shown in FIG. 5 is for illustration purposes only.

In all of the disclosed embodiments, the economizer circuit assists in providing the distinct temperatures that are to be achieved by one or several of the evaporators. That is, by providing the economizer circuit, the present invention is better able to meet the temperature goals, and, in particular, allow the environment to be cooled to a lower temperature.

Other multiples of compressors and compressor banks can be utilized. Also, the discharge valves can be of a shut-off or adjustable type (through modulation or pulsation), providing additional system control flexibility in the latter case.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

a plurality of compressors, where at least two of said compressors deliver a refrigerant to a common discharge manifold leading to a common condenser, such that refrigerant from said at least two compressors will intermix in the common discharge manifold, refrigerant passing through said common condenser, and then expanding into a plurality of evaporators, said plurality of evaporators associated with said plurality of said compressors, where said at least two compressors are connected to a separate evaporator of said plurality of evaporators; and an economizer circuit between said common condenser and at least one of said plurality of evaporators.

2. The refrigerant cycle as set forth in claim 1, wherein said plurality of compressors includes at least three compressors.

3. The refrigerant cycle as set forth in claim 1, wherein at least one of said plurality of compressors is a compressor bank having its own plurality of compressors receiving refrigerant from a common suction manifold leading from a common evaporator.

4. The refrigerant cycle as set forth in claim 1, wherein said economizer circuit includes an economizer heat exchanger, and a main flow of refrigerant passing through said economizer heat exchanger then passes downstream to less than said plurality of evaporators.

5. The refrigerant cycle as set forth in claim 1, wherein said economizer circuit includes an economizer heat exchanger, and a main flow of refrigerant passing through said economizer heat exchanger then passing downstream to a plurality of said evaporators.

6. The refrigerant cycle as set forth in claim 4, wherein refrigerant passing downstream of said economizer heat exchanger passes to only one of said evaporators.

7. The refrigerant cycle as set forth in claim 1, wherein said economizer circuit includes a tapped flow of refrigerant that is tapped off of a main flow of refrigerant and passed through an economizer expansion device, and then to an economizer heat exchanger, said tapped flow of refrigerant being returned to an intermediate compression point in at least one of said compressors.

8. The refrigerant cycle as set forth in claim 1, wherein suction modulation valves are placed on suction lines leading to said compressors.

9. The refrigerant cycle as set forth in claim 1, wherein discharge shut-off valves are placed on a discharge line downstream of at least one of said plurality of compressors.

10. The refrigerant cycle as set forth in claim 1, wherein a by-pass line connects at least one intermediate compression port of at least one of said plurality of said compressors to at least one suction port of at least one of said plurality of said compressors.

11. A method of operating a refrigerant cycle comprising the steps of:

1) providing a refrigerant cycle including a plurality of compressors where at least two of said compressors delivering refrigerant to a common condenser through a common discharge manifold, refrigerant from said plurality of compressors intermixing in said common discharge manifold, then passing to said common condenser, and then passing from said common condenser to a plurality of evaporators, with each of said evaporators delivering refrigerant to one of said plurality of compressors, and an economizer circuit incorporated into said refrigerant cycle, said economizer circuit being associated with at least one of said plurality of evaporators such that refrigerant passing to said at least one of said plurality of evaporators has passed through an economizer heat exchanger prior to reaching said at least one of said plurality of evaporators; and 2) operating said refrigerant cycle by independently controlling refrigerant flow to each of said evaporators to achieve a desired condition for an environment conditioned by each of said evaporators, and selectively directing refrigerant through said economizer circuit to provide additional capacity to said at least one of said plurality of evaporators.

12. The method as set forth in claim 11, wherein at least one of said plurality of compressors includes a compressor bank including its own plurality of compressors, and said compressor bank being controlled to achieve a desired capacity within an associated environment to be controlled.

13. The method as set forth in claim 11, wherein refrigerant passing through said economizer heat exchanger being directed to less than said plurality of evaporators.

14. The method as set forth in claim 13; wherein refrigerant passing through said economizer heat exchanger is sent to each of said plurality of evaporators.

15. The method as set forth in claim 13, wherein refrigerant passing through said economizer heat exchanger is directed to only one of said evaporators.

16. The method as set forth in claim 11, wherein said economizer circuit includes a tapped flow of refrigerant that is tapped off of a main flow of refrigerant and passed through an economizer expansion device, and then to an economizer heat exchanger, said tapped flow of refrigerant being returned to an intermediate compression point in at least one of said compressors.

17. The method as set forth in claim 11, wherein a by-pass line connects at least one intermediate compression port of at least one of said plurality of compressors to at least one suction port of at least one of said plurality of compressors, said by-pass line being selectively opened.

18. The method as set forth in claim 11, wherein suction modulation valves are placed on suction lines leading to at least one of said plurality of compressors, said suction modulation valves being selectively controlled.

19. The method as set forth in claim 11, wherein discharge shut-off valves are placed on a discharge line downstream of at least one of said plurality of compressors, and said discharge shut-off valves being closed to block flow of refrigerant through said discharge line of said at least one of said plurality of compressors.

* * * * *